United States Patent [19]

Elliott et al.

[11] 3,931,469

[45] Jan. 6, 1976

[54] CROSSOVER NETWORK FOR A MULTI-ELEMENT ELECTROSTATIC LOUDSPEAKER SYSTEM

[75] Inventors: Douglas M. Elliott, Milwaukee, Wis.; Alpha M. Wiggins, Punta Gorda, Fla.

[73] Assignee: Koss Corporation, Milwaukee, Wis.

[22] Filed: June 21, 1974

[21] Appl. No.: 481,533

[52] U.S. Cl. ..... 179/1 D; 179/111 R

[51] Int. Cl.[2] ..... H04R 3/14

[58] Field of Search ..... 179/1 D, 111 R, 111 E

[56] References Cited

UNITED STATES PATENTS 2,934,611 4/1960 Lindenberg ..... 179/111 R

FOREIGN PATENTS OR APPLICATIONS 345,342 3/1931 United Kingdom ..... 179/111 R 791,335 2/1958 United Kingdom ..... 179/111 R

*Primary Examiner*—William C. Cooper
*Assistant Examiner*—George G. Stellar
*Attorney, Agent, or Firm*—Quarles & Brady

[57] ABSTRACT

A four-way electrostatic speaker system includes four step-up transformers which have their primary windings connected in a series-parallel circuit across an audio signal source. Electrostatic drivers connect to the secondary windings of each step-up transformer and each forms a parallel resonant circuit which is tuned to an audio frequency within the operating range of the electrostatic driver. The impedance reflected into the primary winding of each step-up transformer is such that the attached electrostatic driver predominantly receives frequencies within its operating range. The necessity of a separate crossover network is thus eliminated.

7 Claims, 2 Drawing Figures

CROSSOVER NETWORK FOR A MULTI-ELEMENT ELECTROSTATIC LOUDSPEAKER SYSTEM

BACKGROUND OF THE INVENTION

The field of the invention is electrostatic loudspeaker systems and more specifically, systems having two or more electrostatic driver elements, or speakers, which operate over different frequency ranges in the audio spectrum.

To provide an efficient electrostatic loudspeaker system, drivers of differing sizes are combined to cover the entire audio spectrum. Each is designed to operate over a limited frequency range and the audio output signal applied to the speaker system is coupled to a crossover network that includes filters which direct the frequency components of the audio signal to the appropriately designed electrostatic driver element. The crossover network in a two-way speaker system establishes two frequency ranges and may, for example, direct audio frequencies below 500 Hertz to a bass driver element and direct audio frequencies above 500 Hertz to a tweeter drive element. The coils and capacitors which are required in the filters of such crossover networks are bulky, heavy, and add considerable expense to the speaker system. Such crossover networks become even more complex and expensive when three- and four-way speaker systems are contemplated.

SUMMARY OF THE INVENTION

The present invention relates to an electrostatic speaker system having a plurality of driver elements which are designed to operate over different audio frequency ranges, and more specifically, to an improved crossover network for such a speaker system. As is well known in the art, electrostatic drivers include a pair of fixed conductive plates which are spaced apart on opposite sides of an insulating diaphragm element. Recognizing that such an electrostatic driver is essentially a capacitor of relatively fixed value, the present invention contemplates a crossover network in which a parallel resonant circuit is formed by the electrostatic driver and the secondary winding of a step-up transformer to which it is connected. Each parallel resonant circuit thus formed is tuned to a frequency that is within the operating range of its associated driver. More specifically, in a loudspeaker system according to the present invention the plates of a first electrostatic driver designed to operate over one frequency range are connected to the secondary winding of a first step-up transformer having a primary winding connected to an audio signal source, and the plates of a second electrostatic driver designed to operate over another frequency range are connected to the secondary winding of a second step-up transformer which has a primary winding also connected to the audio signal source. The secondary winding of each step-up transformer forms a parallel L-C circuit, or tank circuit, with the driver to which it connects, and the inductance of each step-up transformer secondary winding is selected to tune each tank circuit to a frequency within the designed operating range of its associated electrostatic driver.

As a result of the "tuned" secondary circuits on each step-up transformer, the impedance reflected into its primary winding increases substantially for frequencies within the operating range of its associated driver. The primary windings of the step-up transformers are connected together in series with an impedance device across the audio signal source. The impedance of each primary winding is minimal for frequencies substantially above or below the resonant frequency of its associated tuned secondary, and substantially all of the audio signal power at frequencies outside the operating range of its associated electrostatic drive is dissipated by either a series connected impedance device or another series connected step-up transformer. On the other hand, the impedance of each primary winding is substantially greater than either a series connected impedance device or another series connected step-up transformer for audio frequencies in a frequency band centered around the resonant frequency of its secondary circuit. As a consequence, a large portion of the audio signal power at frequencies within this band is coupled to its secondary circuit and applied to the electrostatic driver therein.

It is a general object of the present invention to eliminate the conventional crossover network required in prior electrostatic speaker systems. Unlike prior systems which require both step-up transformers and a crossover network, the present invention uses the step-up transformers to provide a second function previously performed by the crossover network. The added filters are therefore eliminated, thus providing a substantial reduction in the size, weight and cost of the speaker system.

The foregoing and other objects and advantages of the invention will appear from the following description. In the description reference is made to the accompanying drawings which form a part hereof, and in which there is shown by way of illustration a preferred embodiment of the invention in a four-way electrostatic speaker system. Such embodiment does not necessarily represent the full scope of the invention, and reference is made to the claims herein for interpreting the breadth of the invention.

DESCRIPTION OF THE PREFERRED EMBODIMENT

Figure 1:
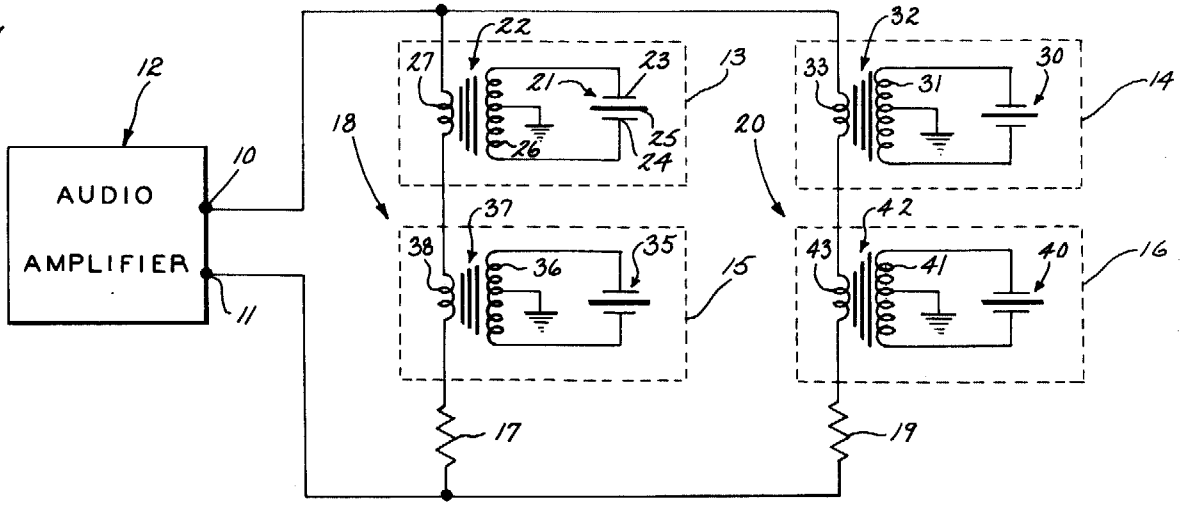
FIG. 1 is an electrical schematic diagram of a speaker system which incorporates the invention.

Referring to FIG. 1, a four-way electrostatic speaker system is shown connected to a pair of output terminals 10 and 11 on an audio amplifier 12. The amplifier 12 is a commercially available high fidelity power amplifier having a frequency response which encompasses the entire spectrum, and since it is designed to connect directly to an electrodynamic loudspeaker system, the impedance across the output terminals 10 and 11 is relatively low, and the voltage of the audio signal which it generates is relatively low.

The four-way electrostatic speaker system of the present invention includes a bass unit 13, a mid-bass unit 14, a treble unit 15 and a tweeter unit 16. The bass unit 13 is connected in series with both the treble unit 15 and an impedance device 17 to form a first series branch 18 which connects across the amplifier output terminals 10 and 11. Similarly, the mid-bass unit 14 is connected in series with both the tweeter unit 16 and a second impedance device 19 to form a second series branch 20 across the amplifier output terminals 10 and 11. In the preferred embodiment described herein the impedance devices 17 and 19 are each resistors which are selected to provide a total of 6 ohms in each series branch 18 and 20.

The bass unit 13 is comprised of an electrostatic driver 21 and a step-up transformer 22. The electrostatic driver 21 includes six panels (not shown in the drawings) each of which has a pair of fixed plates which are electrically connected in parallel and indicated collectively at 23 and 24, and a movable diaphragm electrically connected in parallel and indicated at 25. The diaphragm 25 may include an electret foil which eliminates the necessity of a d-c bias voltage or, as in the preferred embodiment described herein, it may include the more conventional electrostatic speaker unit which requires the application of a high voltage d-c bias voltage to its diaphragm. The electrostatic driver 21 is designed to operate in the frequency range of 30 to 250 Hertz, and it has a capacitance of 2000 picofarads across its fixed plates 23 and 24.

The fixed plates 23 and 24 are connected to a secondary winding 26 on the step-up transformer 22 to form a parallel resonant circuit which is tuned to a frequency of approximately 47 Hertz. The step-up transformer 22 includes a primary winding 27 which is connected in the series branch 18 and the turns ratio of the secondary to the primary is 322. A center tap on the secondary winding 26 is connected to circuit ground, and the inductance of the secondary winding 26 is 5190 Henries when 5 volts is applied to the primary winding 27. At its resonant frequency, the impedance of the tank circuit formed by the secondary winding 26 and the electrostatic driver unit 21 is at a peak, and this is reflected into the primary winding 27 as an impedance of approximately 39 ohms. At frequencies above 47 Hertz the impedance of the primary winding 27 declines rapidly and becomes capacitive, and at frequencies below resonance the impedance of the primary winding 27 declines and becomes inductive. At frequencies above 612 Hertz the impedance of the primary winding 27 is less than 2 ohms.

The remaining units 14, 15 and 16 are constructed in a manner similar to the bass unit 13, but are tuned to operate in different frequency ranges within the audio spectrum. The mid-bass unit 14 includes an electrostatic driver 30 comprised of one panel having a capacitance of 230 picofarads across its fixed plates, which are connected to a secondary winding 31 on a mid-bass step-up transformer 32. The transformer 32 has a primary winding 33 which is connected in the series branch 20 and is magnetically coupled to the secondary winding 31. A center tap on the secondary winding 31 is connected to circuit ground, and it has an inductance of 226 Henries when 5 volts is applied to the primary winding 33. The turns ratio of the secondary winding 31 to the primary 33 is 292. The mid-bass electrostatic driver 30 is designed to operate in the frequency range of from 250 to 1500 Hertz and the tank circuit formed by the driver 30 and the secondary winding 31 resonates at approximately 700 Hertz. At resonance, the impedance of the primary winding 33 is at a maximum value of approximately 30 ohms and it decreases to less than 1 ohm at frequencies below 87 Hertz and above 2700 Hertz.

The treble unit 15 includes an electrostatic driver 35 comprised of two panels which are designed to operate over the frequency range of from 1500 to 5000 Hertz and which have a combined capacitance of 200 picofarads. The fixed plates on the electrostatic driver 35 connect to a secondary winding 36 on a treble step-up transformer 37 and a primary winding 38 on the transformer 37 is connected in the series branch 18. A center tab on the secondary winding 36 is connected to circuit ground and the secondary winding 36 has an inductance of 24½ Henries when 5 volts is applied to the primary winding 38. The turns ratio of the secondary winding 36 to the primary winding 38 is 169 and the impedance of the primary winding 38 reaches a maximum of approximately 44 ohms at the 2300 Hertz resonant frequency of the treble tank circuit. The impedance of the primary winding 38 drops to less than 1 ohm at frequencies below 600 Hertz and at frequencies above 9600 Hertz.

The tweeter unit 16 includes an electrostatic driver 40 which is comprised of one panel designed to operate in the frequency range of from 5000 to 20,000 Hertz, and which has a capacitance of 91 picofarads. The fixed plates of the tweeter driver 40 connect to a secondary winding 41 on a tweeter step-up transformer 42. A primary winding 43 on the transformer 42 is connected in the second series branch 20 and is magnetically coupled to the secondary winding 41. A center tap on the secondary winding 41 connects to circuit ground and it has an inductance of three and thirty-one hundredths Henries when 5 volts is applied to the primary winding 43. The turns ratio of the secondary to the primary is 127 and the tweeter tank circuit is tuned to resonate at approximately 9,200 Hertz. At resonance, the primary winding 43 reaches a maximum impedance of approximately 150 ohms and it decreases to less than 1 ohm at frequencies below 2700 Hertz.

Figure 2:
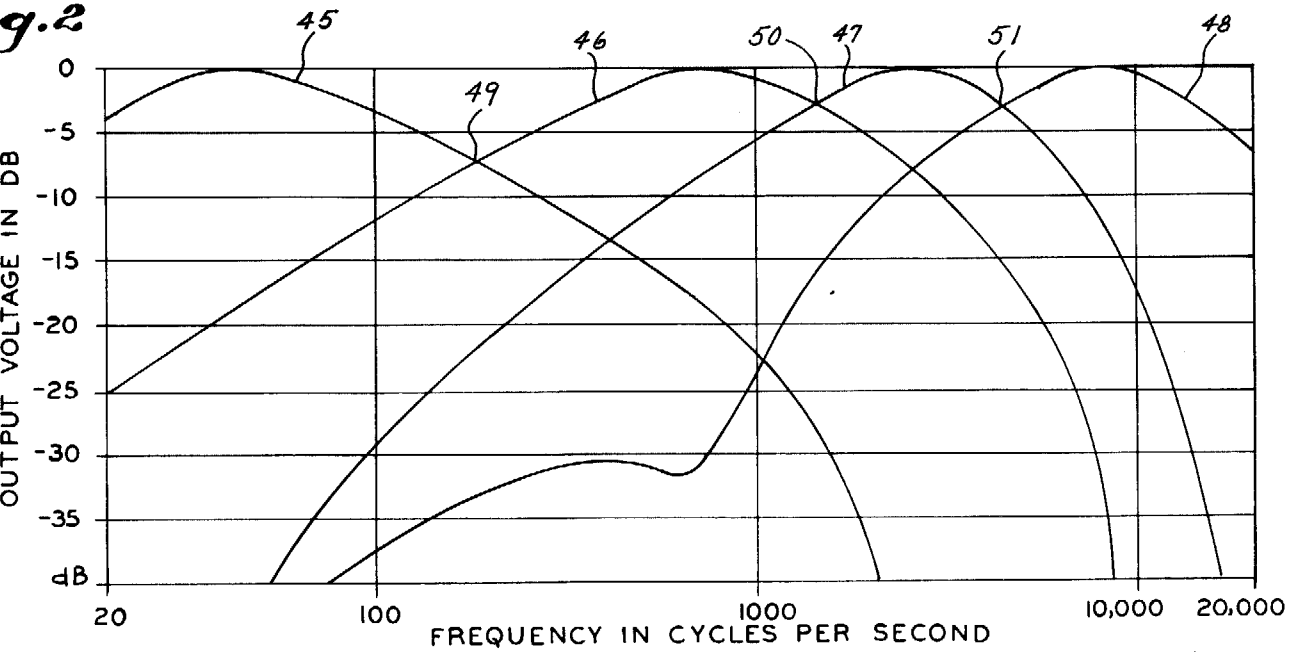
FIG. 2 is a graphic illustration showing the normalized output voltages across the secondary windings of the step-up transformers with the drivers attached.

The performance of the above described speaker system is illustrated by the normalized voltage output curves in FIG. 2, in which a 5-volt audio signal is applied to the four-way speaker system of FIG. 1. The voltage output level of each transformer secondary 26, 31, 36 and 41 with the respective drivers 23, 30, 35 and 40 is measured across the entire audio spectrum. A voltage output curve 45 indicates the output of the bass transformer 22 as a function of frequency, a voltage output curve 46 indicates the output of the mid-bass transformer 32 as a function of frequency, a voltage output curve 47 indicates the output of the treble transformer 37 as a function of frequency, and a voltage output curve 48 indicates the output of the tweeter transformer 42 as a function of frequency. Maximum output is obtained from each transformer at the resonant frequency of its respective tank circuit, and its output drops off rather rapidly to either side of its resonant frequency. The electrical crossover point between the bass transformer 22 and the mid-bass transformer 32 occurs at approximately 190 Hertz as indicated at 49, and at this frequency the electrical outputs of both the bass transformer 22 and the mid-bass transformer 32 are approximately 7 decibels down from their resonant frequency levels. An electrical crossover point 50 occurs at approximately 1,450 Hertz between the mid-bass transformer 32 and the treble transformer 37 and at this frequency the output of both transformers is down approximately 3 decibels from their maximum output. Similarly, an electrical crossover point 51 between the treble transformer 37 and the tweeter transformer 42 occurs at approximately 4700 Hertz and the outputs of these transformers are down approximately 3 decibels from their maximum levels. These particular electrical crossover points were selected to complement the particular electrostatic drivers used, and it should be apparent to those skilled in the art that the electrical crossover points 49, 50 and 51 can be readily altered to meet the specific requirements of the speaker system.

It should also be apparent to those skilled in the art that many variations can be made in the speaker system of FIG. 1 without departing from the spirit of the present invention. For example, in a two-way speaker system, two electrostatic drivers are designed to cover the entire audio spectrum and are connected in series to form a single branch. In such case, the audio spectrum is divided into a lower frequency range in which a bass electrostatic driver is designed to operate and an upper frequency range in which a treble electrostatic driver is designed to operate. The step-up transformer primary windings in each unit are connected in series, and the inductance of their secondary windings are selected to tune each unit to a frequency within its designed operating range. The impedance characteristics of each tank circuit is reflected into its associated primary winding, and as a result, nearly all of the low frequency components of the audio signal are applied to the bass unit to produce sound, and nearly all of the high frequency components are applied to the treble unit. At the crossover point the impedance of the two series connected primary windings are equal in value and the bass unit and treble unit share the applied audio voltage equally at the crossover frequency. The invention can be applied with equal facility to speaker systems containing any number of speaker units.

Although it should be apparent that the present invention may be applied by connecting together two or more speaker units and associated step-up transformers in a series branch across the audio signal source, a substantial advantage is obtained by connecting the speaker units in a series-parallel configuration such as that shown in FIG. 1. More specifically, in the four-way speaker system of the preferred embodiment, the bass unit 13 is connected in the series branch 18 with the treble unit 15 and the mid-bass unit 14 is connected in a separate series branch 20 with the tweeter unit 16. The purpose of this arrangement is to avoid undesiraable resonances which may occur when the tuned resonant frequencies of two series connected units are relatively close together. It has been discovered that when the bass unit 13 is connected in series with the mid-bass unit 14, for example, that the impedance reflected into the primary winding 27 of the bass unit 13 is highly capacitive and the impedance reflected into the primary winding 33 of the mid-bass unit 14 is highly inductive around the crossover frequency of 1950 Hertz. A series resonant circuit is thus established and high currents may be drawn through the two primary windings resulting in a peak in the overall output response of the speaker system. Although such a series resonant circuit is also formed by the bass unit 13 and treble unit 15 in the preferred series-parallel configuration, because this series resonance is far removed from the tuned frequency of each unit the reactance component of the impedance is small in comparison to the distributed resistance of the transformer primaries 27 and 38 and the impedance device 17. A significant peak in the response curve does not, therefore, result. When a plurality of speaker units are combined to form a speaker system according to the present invention, therefore, the resonant frequencies of series connected speaker units should be spaced apart as far as possible for optimal performance.

In addition, although the impedance devices 17 and 19 are discrete components in the preferred embodiment described herein, by increasing the ohmic resistance of the step-up transformer primary windings these components may be eliminated. In any case, however, a minimal amount of resistance is desirable in each series branch to both protect the attached audio amplifier from excessive currents and to aid in suppressing the peak in the output at the series resonant frequency discussed above.

We claim:

1. In an electrostatic speaker system having a pair of input terminals connectable to receive an audio signal from an audio amplifier, the combination comprising:

an electrostatic driver having a pair of terminals connected to a respective pair of fixed plates which present a relatively fixed, highly capacitive impedance across said terminals;

a step-up transformer having a primary winding connected in a series branch across said speaker input terminals to receive said audio signal, and a secondary winding magnetically coupled to said primary winding and electrically connected to the input terminals of said electrostatic driver to form a parallel resonant circuit therewith, the inductance of said secondary winding being selected such that the parallel resonant circuit it tuned to a selected audio frequency, and an impedance device connected in said series branch to voltage divide the audio signal with the primary winding of said step-up transformer.

wherein the impedance of the primary winding of said step-up transformer increases substantially for a range of frequencies about said tuned audio frequency with the result that a majority of the audio signal within said frequency range is applied to said electrostatic driver and a majority of the audio signal outside said frequency range is applied to said impedance device.

2. The electrostatic speaker system as recited in claim 1 in which said impedance device is a resistor having a value which is substantially less than the maximum impedance of said primary winding.

3. The electrostatic speaker system as recited in claim 1 in which said impedance device is the primary winding of a second step-up transformer having a secondary winding which connects to a second electrostatic driver to form a parallel resonant circuit which is tuned to a frequency outside said frequency range.

4. An electrostatic speaker system for reproducing an audio signal generated at a pair of output terminals on an audio amplifier, the combination comprising:

a first electrostatic driver having a pair of plates connectable to receive an audio signal, said first electrostatic driver being designed to operate over a first preselected audio frequency range;

a second electrostatic driver having a pair of plates connectable to receive an audio signal, said second electrostatic driver being designed to operate over a second preselected audio frequency range;

a first step-up transformer having a primary winding coupled to one of said audio amplifier output terminals to receive said audio signal which has frequencies in both of said preselected audio frequency ranges, and a secondary winding connected to the plates of said first electrostatic driver to form a first parallel resonant circuit which is tuned to a frequency in said first preselected audio frequency range; and a second step-up transformer having a primary winding connected in series with the primary winding of said first step-up transformer and coupled to the other of said output terminals on said audio amplifier to receive said audio signal having frequencies in both of said preselected audio frequency ranges, and a secondary winding connected to the plates of said second electrostatic driver to form a second parallel resonant circuit which is tuned to a frequency in said second preselected audio frequency range.

5. The electrostatic speaker system as recited in claim 4 wherein a first impedance device is connected in series with the primary winding of said first step-up transformer and the primary winding of said second step-up transformer.

6. A four-way electrostatic speaker system, the combination comprising:

a bass unit having a bass electrostatic driver connected to the secondary winding of a bass step-up transformer to form a parallel resonant circuit therewith which is tuned to a first audio frequency;

a mid-bass unit having a mid-bass electrostatic driver connected to the secondary winding of a mid-bass step-up transformer to form a parallel resonant circuit therewith which is tuned to a second audio frequency higher than said first audio frequency;

a treble unit having a treble electrostatic driver connected to the secondary winding of a treble step-up transformer to form a parallel resonant circuit therewith which is tuned to a third audio frequency higher than said second audio frequency; and a tweeter unit having a tweeter electrostatic driver connected to the secondary winding of a tweeter step-up transformer to form a parallel resonant circuit therewith which is tuned to a fourth audio frequency higher than said third audio frequency;

wherein a primary winding on said bass step-up transformer is connected in series with a primary winding on said treble step-up transformer to form a first series branch, and a primary winding on said mid-bass step-up transformer is connected in series with a primary winding on said tweeter step-up transformer to form a second series branch.

7. The four-way electrostatic speaker system as recited in claim 6 in which an impedance device is connected in series with each of said series branches.

* * * * *